US006318844B1

(12) United States Patent
Witteveen et al.

(10) Patent No.: US 6,318,844 B1
(45) **Date of Patent: *Nov. 20, 2001**

(54) PRINT HEAD FOR AN INK-JET PRINTER

(75) Inventors: Bontko Witteveen, Venlo; Erik Christian Nicolaas Puik, Maarheeze, both of (NL)

(73) Assignee: Océ-Nederland, B.V., Venlo (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/798,799

(22) Filed: Feb. 12, 1997

(30) Foreign Application Priority Data

Feb. 14, 1996 (EP) ..... 96200358

(51) Int. Cl.[7] ..... B41J 2/015; B41J 2/14; B41J 2/045

(52) U.S. Cl. ..... 347/48; 347/20; 347/70; 347/71

(58) Field of Search ..... 347/48, 71, 70

(56) References Cited

U.S. PATENT DOCUMENTS 4,688,048 * 8/1987 Uematsu et al. ..... 347/48
5,757,404 * 5/1998 Witteveen et al. ..... 347/71
5,818,482 * 10/1998 Ohta et al. ..... 347/70
6,120,124 * 9/2000 Atobe et al. ..... 347/68

FOREIGN PATENT DOCUMENTS 4328433 3/1995 (DE) .
402172 12/1990 (EP) .
608135 7/1994 (EP) .
657289 6/1995 (EP) .
748691 12/1996 (EP) .
4-141429 * 5/1992 (JP) ..... 347/71
92/10367 * 6/1992 (WO) ..... 347/71

* cited by examiner

*Primary Examiner*—John Barlow
*Assistant Examiner*—An H. Do
(74) *Attorney, Agent, or Firm*—Birch, Stewart, Kolasch & Birch, LLP

(57) ABSTRACT

A print head for an ink-jet printer has a nozzle member defining a plurality of ink channels arranged side-by-side and each terminating in a nozzle. A plurality of actuators are disposed on one side of the nozzle member and respectively face one of the ink channels for pressurizing the ink liquid therein, in order to expel ink droplets through the nozzles. A support for supporting the actuators on the side opposite to the ink channels is provided and a plurality of connecting portions mechanically connect the support to the nozzle member. At least one of the connecting portions is arranged between the actuators. The connecting portions are spaced apart from one another in a longitudinal direction of the ink channels and are formed, for example, by bars extending transversely to the ink channels.

16 Claims, 7 Drawing Sheets

PRINT HEAD FOR AN INK-JET PRINTER

FIELD OF THE INVENTION

The invention relates to a print head for an ink-jet printer comprising a nozzle member defining a plurality of ink channels arranged side-by-side and each terminating in a nozzle, a plurality of actuators disposed on one side of the nozzle member and respectively facing one of the ink channels for pressurizing the ink liquid therein, in order to expel ink droplets through the nozzles, support means supporting the actuators on the side opposite to the ink channels, and a plurality of connecting portions mechanically connecting the support means to the nozzle member, at least one of said connecting portions being arranged between the actuators.

DESCRIPTION OF THE INVENTION

A conventional print head of this type has been disclosed in EP-B-0 402 172. The nozzle member is formed by a nozzle plate in which recesses have been formed for defining the ink channels and the nozzles. On the side facing the actuators, the recesses are covered by a flexible plate which is sandwiched between the nozzle plate and a support plate. The actuators are formed by elongated piezoelectric plates formed integrally with and vertically projecting from the support plate, so that their edge portions engage the flexible plate. The piezoelectric actuators are provided with electrodes, and when a voltage is applied to these electrodes, the piezoelectric plate expands and presses against the flexible plate so that the latter is slightly bent and compresses the liquid in the ink channel. Thus, on demand, individual ink droplets can be expelled from nozzles by energizing the electrodes of the piezoelectric actuators.

However, when an individual actuator is energized and expands, this actuator also tends to bend the support plates so that the neighboring actuators are drawn away from the associated ink channels, with the result that the pressure in the neighboring ink channels is reduced. Thus, an undesired cross-talk phenomenon occurs, i.e., the expansion of an individual actuator has an influence not only on the ink channel associated therewith but also on the neighboring ink channels. In order to reduce this cross-talk phenomenon, the connecting portions are provided between the individual actuators.

In the conventional device, the connecting portions are shaped as continuous bars fixed on the surface of the support plate and extending lengthwise of the ink channels. These bars are fixed to the flexible plate at positions opposite to the walls of the nozzle plate which separate the individual ink channels. Since the flexible plate is also fixed to these walls of the nozzle plate, a mechanical connection with a certain tensile strength is established between the nozzle plate and the support plate. Thus, when an individual actuator is energized, the reaction force of this actuator is balanced by the tension force of the neighboring connecting portions, so that the support plate is prevented from bending and the cross-talk is suppressed.

When the print head is used with a hot melt ink system, the nozzle plate has to be heated in order to keep the temperature of the ink above the melting point. In this case the print head is subject to thermal stresses due to differential thermal expansion of the nozzle plate and the flexible plate on the one hand and the support plate on the other hand. In this respect, the conventional construction has the drawback that the bar-shaped connecting portions increase the strength of the print head only in a longitudinal direction of the ink channels but not in the direction orthogonal thereto, i.e. in the direction in which the nozzles are aligned.

The bar-shaped connecting portions intervening between the individual actuators also limit the density with which the ink channels and nozzles can be arranged and hence the spacial resolution of the print head.

SUMMARY OF THE INVENTION

The present invention has been devised in order to overcome or mitigate these problems. The print head according to the invention is characterized in that the connecting portions are spaced apart from one another in the longitudinal direction of the ink channels.

Since the connecting portions do not extend continuously over the whole length of the ink channels, the print head according to the invention is light-weight and reduces the dissipation of heat via the connecting portions. Nevertheless, the connecting portions function to absorb the reaction forces of the actuators and to prevent bending of the support plate, so that cross-talk is suppressed similarly as in the prior art.

In one embodiment of the invention, the actuating means for each individual ink channel comprise at least two separate actuators which are disposed in the gaps between the connecting portions, and the connecting portions are shaped as continuous bars extending in transverse direction of the ink channels. Thus, the connecting portions significantly increase the strength of the print head in the transverse direction, i.e. the direction, in which the nozzles are aligned. As a result, the thermal stability of the nozzle head is improved.

It has to be noted that the number of bar-shaped connecting portions can be significantly smaller than in the prior art, because each bar can absorb the reaction forces of the actuators for all ink channels, so that it is not necessary to have bars intervening in each of the clearances between the ink channels.

In addition, the spacings between the actuators and hence the spacings between the nozzles can be reduced so that a higher spacial resolution of the print head is achieved.

In another embodiment of the invention, the connecting portions are formed as separated insulae or pillars which are disposed in the intervals between the actuators. In this case, the actuators may be formed as continuous plates which extend over the whole length of the ink channels, as in the prior art. The pillars have a comparatively high tensile strength in the direction normal to the plane of the nozzle plate, but can readily be deformed in a shear mode in both directions in parallel with the nozzle plate, so that differential thermal expansion of the nozzle plate and the support plate can be absorbed by the pillars and will not lead to a substantial deformation of the nozzle plate.

This embodiment also permits a reduction in the spacing between the ink chambers. To this end, the opposing lateral surfaces of the plate-like piezoelectric actuators are formed with grooves for accommodating the pillar-shaped connecting portions.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
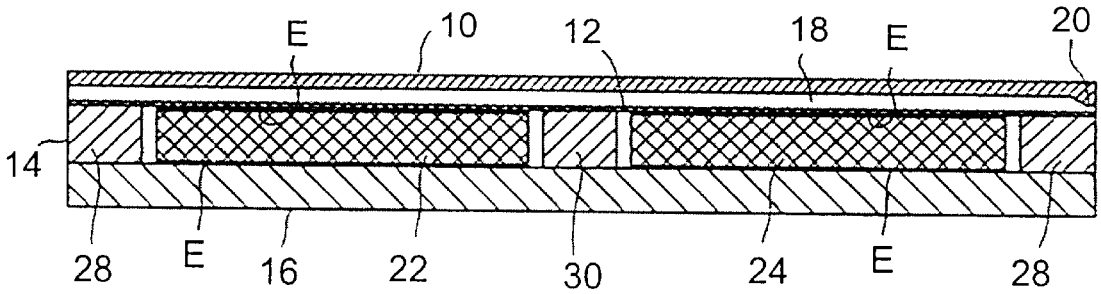
FIG. 1 is a longitudinal section of a print head according to a first embodiment.

The print head shown in FIG. 1 has a sandwich structure composed of a nozzle plate 10, a comparatively thin flexible film or plate 12 fixed to the lower surface of the nozzle plate, a frame member 14 fixed to the lower surface of the flexible plate and a support plate 16 fixed to the lower surface of the frame member. The lower surface of the nozzle plate 10 is formed with a plurality of recesses each defining an elongate ink channel 18 and a nozzle 20 at one end of the ink channel. The ink channels 18 of which only one can be recognized in FIG. 1 are disposed side-by-side in the direction normal to the plane of the drawing in FIG. 1. The flexible plate 12 defines the lower wall of the ink channels 18 and nozzles 20 and is fixed to the wall portions or ribs of the nozzle plate 10 which separate the individual ink channels.

Each ink channel 18 is associated with an actuator unit which is formed by a plurality of separate piezoelectric, plate-like actuators 22, 24 (two in this example). These actuators are formed as piezoelectric plates which extend lengthwise of the ink channel 18 and are accommodated in the frame member 14. The lower edges of the plate-like actuators 22, 24 engage the support plate 16, whereas their top edges engage the flexible plate 12. The actuators may be fixedly connected to or formed integrally with the support plate 16.

As is generally known in the art, the actuators 22, 24 are provided with electrodes E and may be caused to expand and contract in a vertical direction in FIG. 1 by applying a voltage to these electrodes. The ends of the ink channels 18 opposite to the nozzles 20 are connected to a common ink reservoir (not shown) for hot melt ink. In operation, the nozzle plate 10 and the ink reservoir are heated above the melting point of the ink, and the ink channels 18 are filled with liquid ink. Thus, by contracting and expanding the actuators 22, 24, an acoustic pressure wave can be generated individually in each ink channel 18. This pressure wave will propagate to the nozzle 20, so that an ink droplet is expelled from the nozzle.

The actuators 22, 24 are provided with separate electrodes and may be energized at different timings, so that the pressure wave is first generated by the actuator 22 and is then amplified by the actuator 24, as has been proposed in applicant's earlier European patent application No. 0 748 694.

Figure 2:
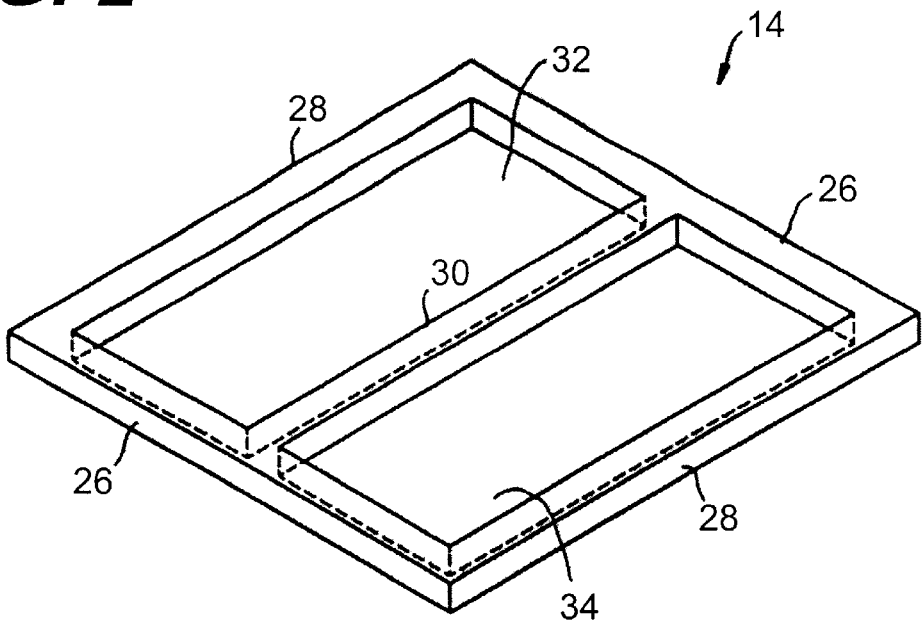
FIG. 2 is a perspective view of a frame member constituting connecting portions of the print head according to FIG. 1.

As is shown in FIG. 2, the frame member 14 comprises an outer frame formed by longitudinal legs 26 and transverse legs 28. The longitudinal legs 26 extend in parallel with the ink channels 18 and are interconnected by a central bar 30 which divides the interior of the frame member into two separate spaces 32, 34 for accommodating the actuators 22 and 24, respectively.

Figure 3A:
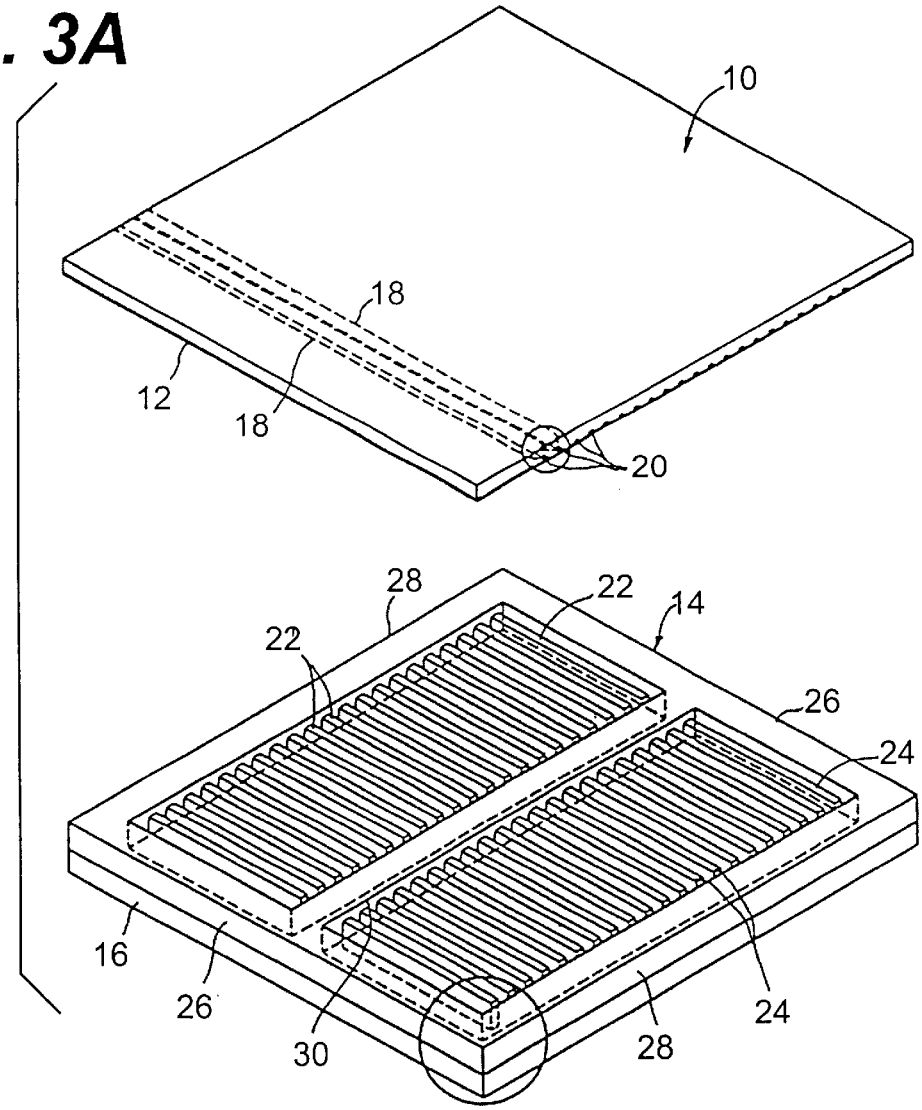
FIG. 3A is an exploded perspective view of the print head shown in FIG. 1.
Figure 3B:
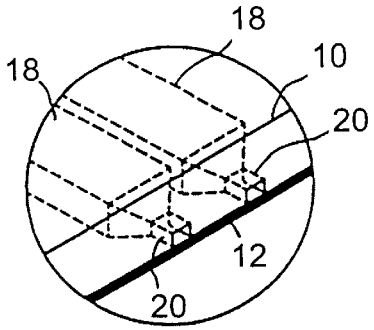
FIG. 3B is an enlargement of a detail of a nozzle plate in FIG. A.
Figure 3C:
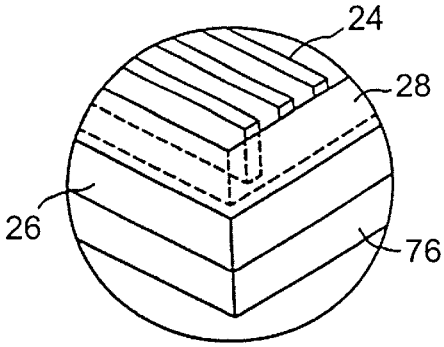
FIG. 3C is an enlargement of a detail of a support plate in FIG. 3A.

The arrangement of the actuators 22, 24 and the ink channels 18 in relation to the frame member 14 is shown in FIGS. 3A, 3B and 3C. The frame member 14 and the support plate 16 are provided for supporting the actuators 22, 24 against the reaction force of the flexible plate 18 and the pressurized ink. The transverse legs 28 and the bar 30 of the frame member 14 especially serve as connecting portions for mechanically connecting the support plate 16 to the nozzle plate 10 (via the flexible plate 12) in the vicinity of each of the ink channels 18. When a pair of actuators 22, 24 is expanded, the reaction force is transmitted to the corresponding stripe-shaped portion of the support plate 16 and tends to cause a bending deflection of the plate 16, especially in the central portion thereof. If no counter measures were taken, part of the mechanical energy provided by an active pair of actuators could be transmitted to the neighboring actuators and could disturb the droplet formation in the neighboring ink channels. In the embodiment shown, this effect is suppressed mainly by the bar 30 of the support frame, which extends over the central portion of the support plate 16 and efficiently prevents the deflection of this support plate. A similar effect is achieved by the transverse legs 28 of the frame member.

Since the actuators 22, 24 are disposed in the spaces 32, 34 with no support portions intervening between the individual ink channels, the actuators as well as the ink channels 18 and the nozzles 20 may be arranged at narrow spacings, as will be appreciated from FIG. 3B.

Figure 4A:
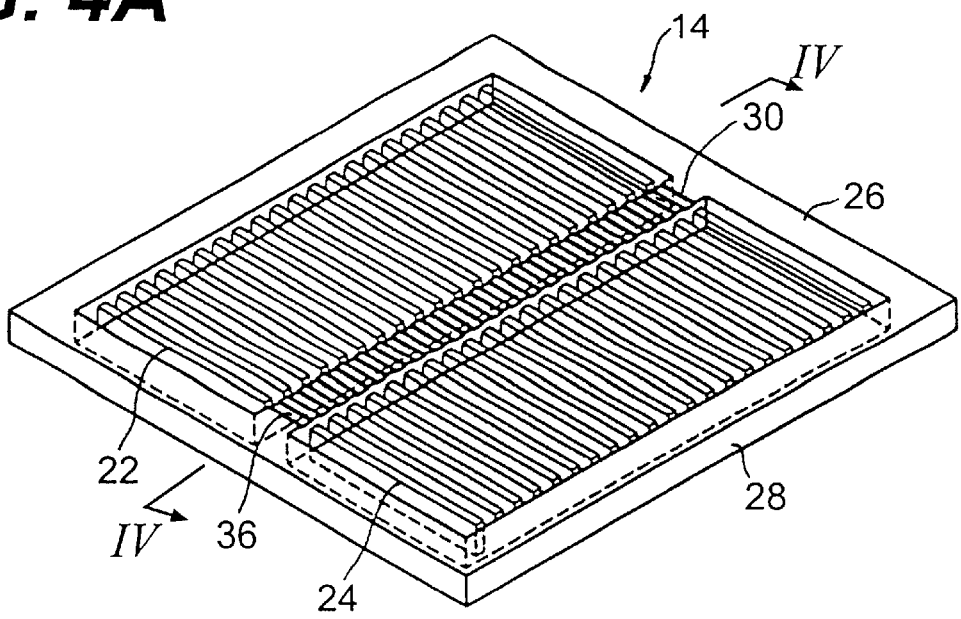
FIG. 4A is a perspective view of a frame member and actuators of a print head according to a modification of the first embodiment.
Figure 4B:
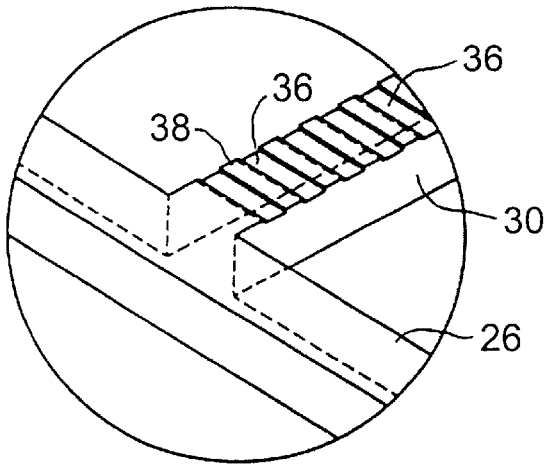
FIG. 4B is an enlargement of a detail in FIG. 4A.
Figure 4C:
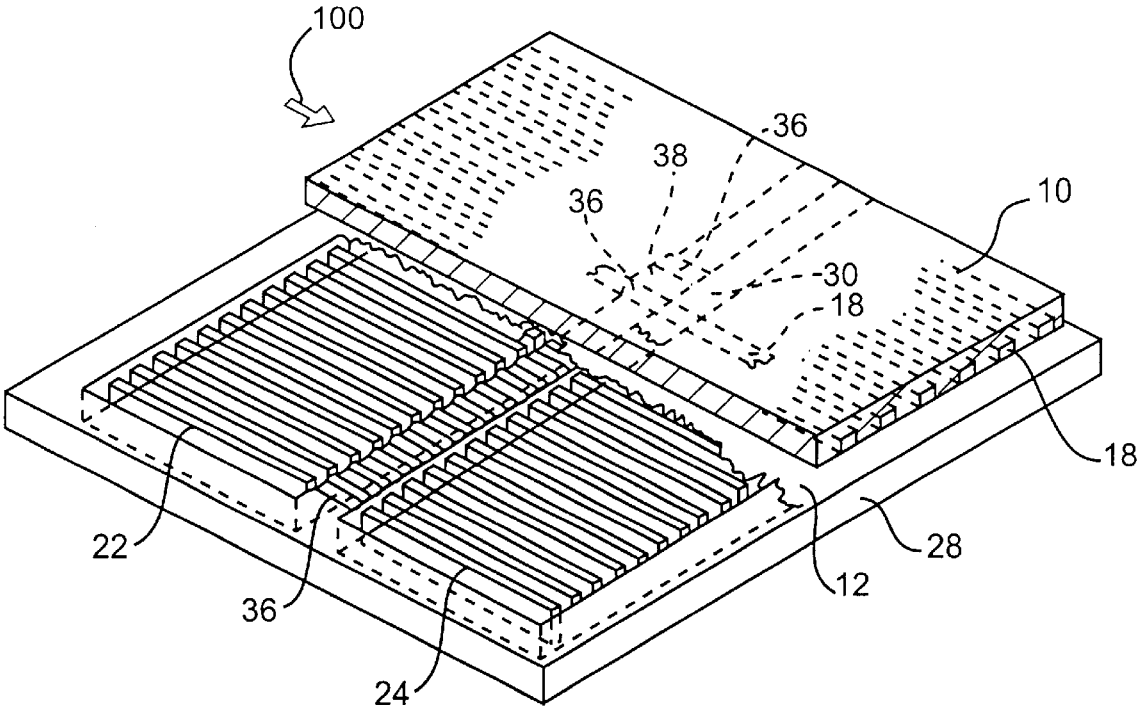
FIG. 4C is a perspective view of a frame member and actuators with grooves arranged in a longitudinal direction according to the modification of the first embodiment.
Figure 4D:
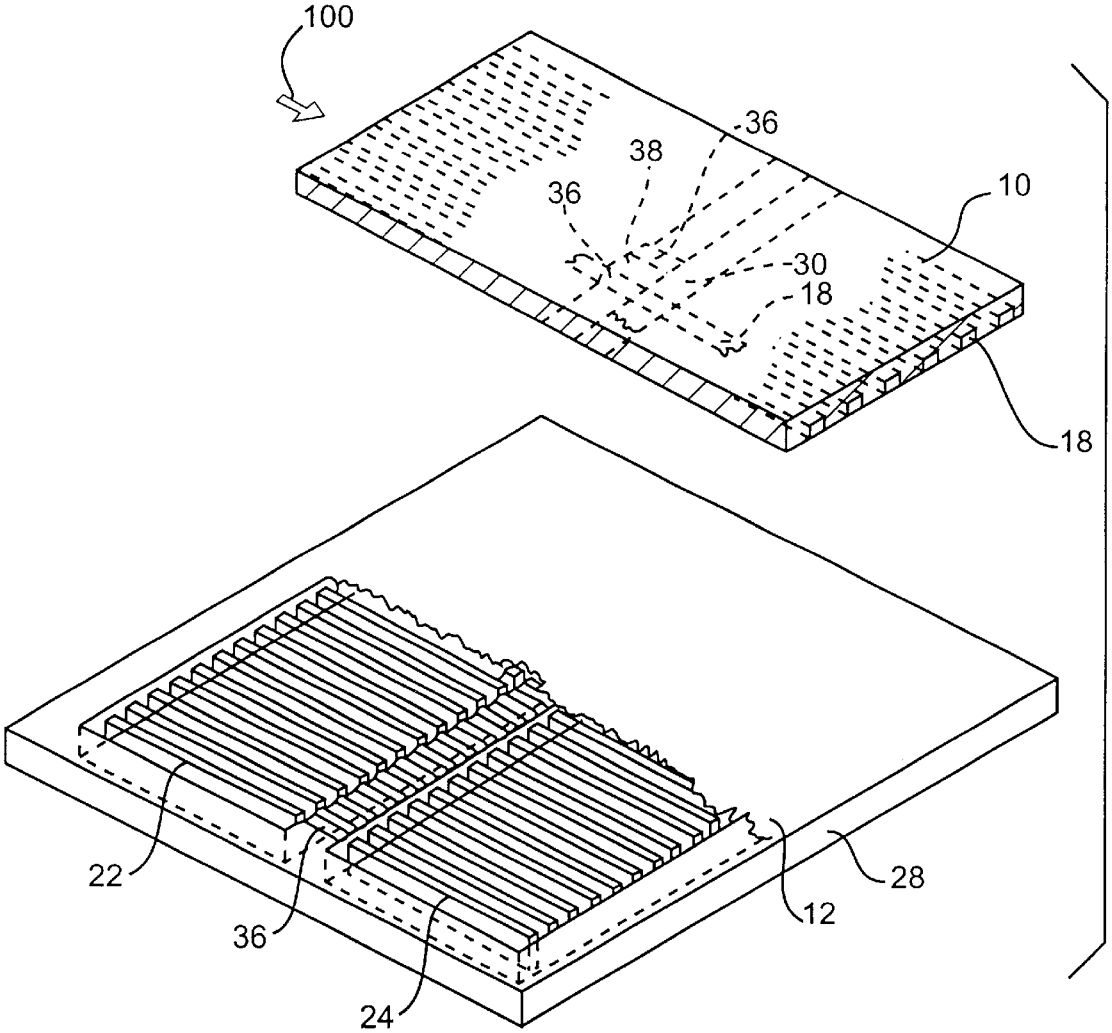
FIG. 4D is an exploded perspective view of a print head as shown in FIG. 4C.
Figure 4E:
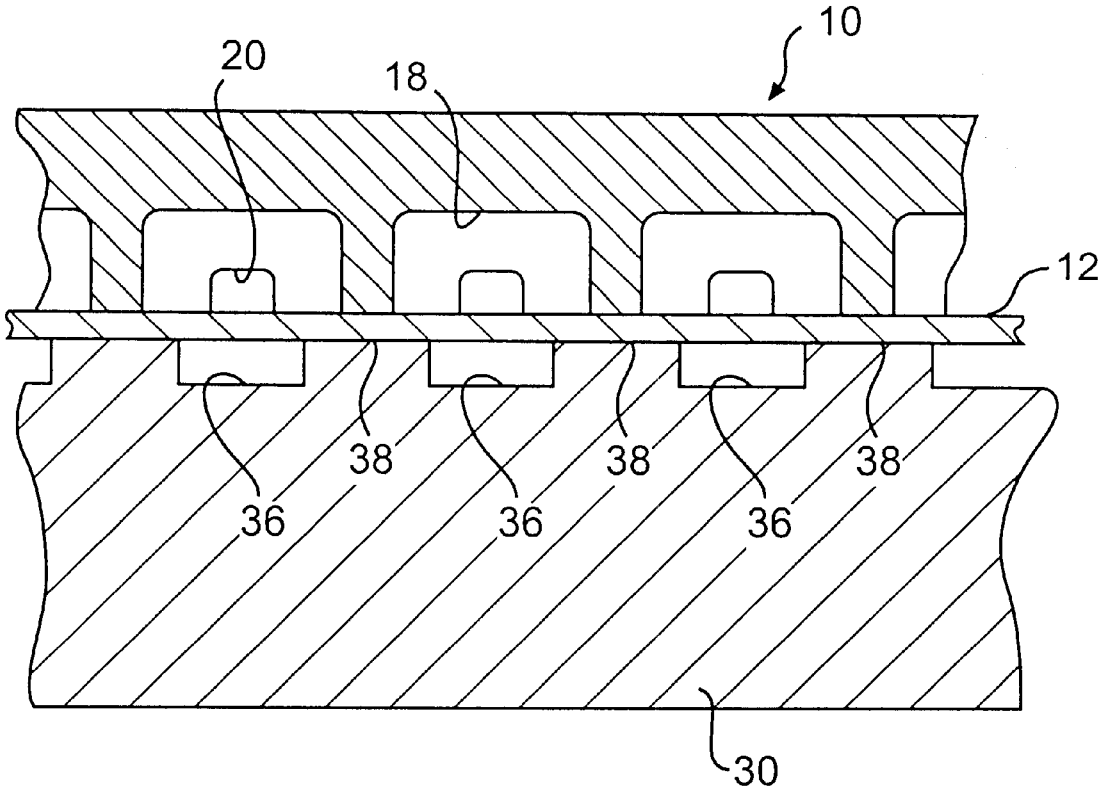
FIG. 4E is a cross-sectional view of a print head according to the first embodiment.

FIGS. 4A and 4B show a modification of the embodiment discussed above. According to this modification, the surface of the bar 30 facing the flexible plate 12 is formed with a plurality of shallow grooves 36 which are respectively aligned with the pairs of actuators 22, 24. Thus, the bar 30 is connected to the flexible plate 12 only in the raised portions 38 hfi between the grooves 36. This has the advantage that the portions of the flexible plate 12 covering the ink channels 18 and bridging the grooves 36 are not rigidly connected to the bar 30, so that the flexible plate can more readily be deflected by the actuators 22, 24.

A useful method for manufacturing the nozzle head according to the above embodiment will briefly be described hereinbelow. Two solid blocks of piezoelectric material having essentially the same configuration as the spaces 32, 34 of the frame member 14 and provided with electrodes on their upper and lower surfaces are fixed on the support plate 16. As an alternative, a single block may be formed and may then be divided into two blocks by cutting a groove which will later accommodate the bar 30 of the frame member. Then, the two blocks of piezoelectric material are divided into the individual actuators 22 and 24, respectively, by cutting grooves into the piezoelectric material in a longitudinal direction 100 of the ink channels 18. These grooves may be cut by means of a saw, a laser cutter or the like, and each pair of grooves intervening between two of the actuators 22, 24, respectively, may be cut in a single step. The depth of the grooves is preferably so selected that the bottom of the grooves coincides with the top surface of the support plate 16, so that the individual actuators are completely separated from one another.

The frame member 14 is prepared from a material with a high elastic module (i.e., a comparatively rigid material), such as ceramics or metal. This frame member is then disposed on the support plate 16 and is bonded thereto. The surfaces of the frame member 14 and the actuators are made flush, for example by grinding. In case of the embodiment of FIG. 4A, the shallow grooves 36 are then cut into the bar 30. The nozzle plate 10 is prepared separately and is provided with the ink channels 18 and the nozzles 20. Finally, the nozzle plate 10, the flexible plate 12 and the frame member 14 are sandwiched and bonded together in the configuration shown in FIG. 1. In this bonding step, the bar 30 or at least the raised portions 38 thereof are fixedly secured to the flexible plate 12.

Figure 5:
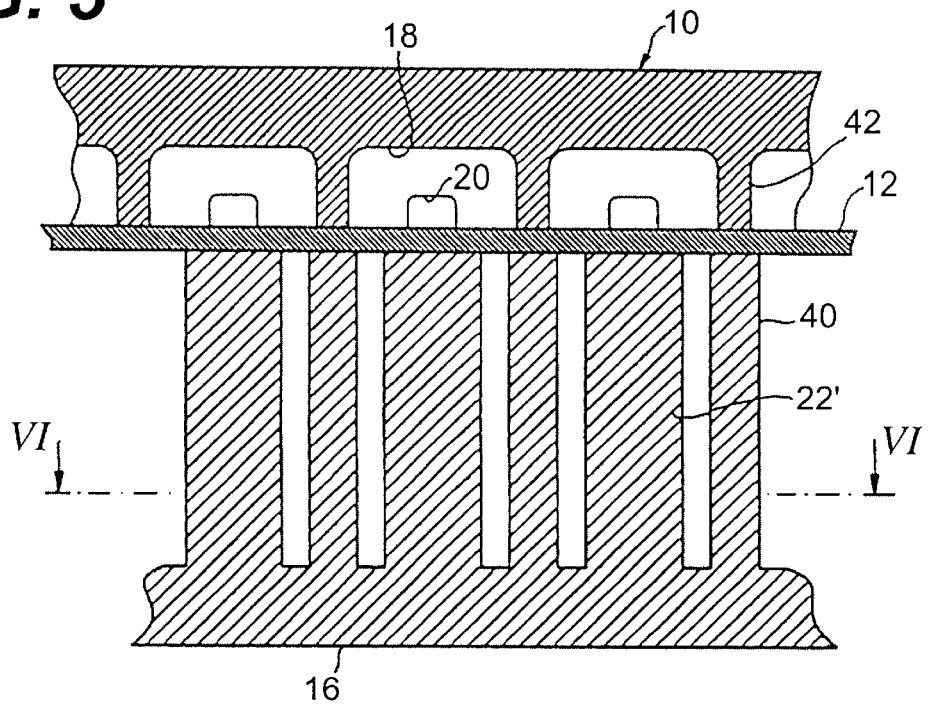
FIG. 5 is a cross-sectional view of a part of a print head according to a second embodiment.
Figure 6:
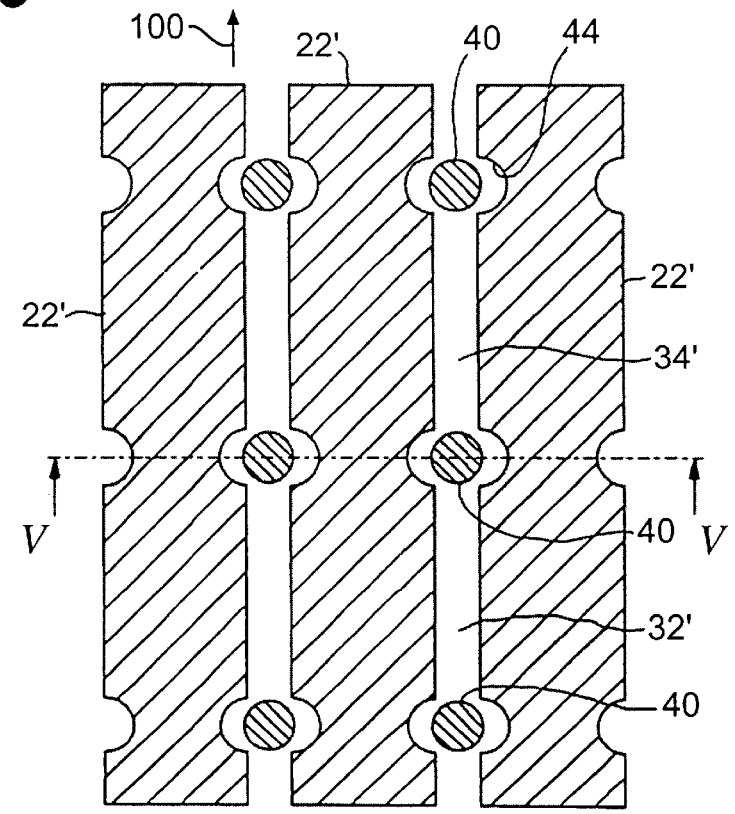
FIG. 6 is a sectional view taken along the line VI—VI in FIG. 5.

FIGS. 5 and 6 show a second embodiment of the nozzle head, in which the actuator unit for each ink channel 18 may be formed by a single actuator 22' extending over the entire length of the ink channel. The connecting portions corresponding to the legs 28 and the bar 30 in the previous embodiment are in this case formed by, one or more rows of individual pillars 40 which are separated by gaps 32', 34' in a longitudinal direction 100 of the ink channels and are respectively disposed in the intervals between the actuators 22'. The pillars 40 may have any suitable cross-sectional shape and may be circular, as in the shown embodiment. Their diameter or thickness substantially corresponds to the thickness of the walls 42 separating the individual ink channels 18 in the nozzle plate 10 (FIG. 5).

In order to provide a sufficient clearance between the pillars 40 and the actuators 22' and nevertheless to allow a narrow spacing of the nozzles 20 and, correspondingly, the ink channels 18 and the actuators 22, the lateral faces of the actuators 22' are formed with grooves 44 in the positions corresponding to the pillars 40.

The actuators 22' and/or the pillars 40 may be formed integrally with the support plate 16. The grooves 44 and also the clearances separating the individual actuators 22' can easily be formed by laser-cutting or the like.

Although not shown in the drawings, the support plate 16 according to the second embodiment may also be provided with a frame surrounding the pillars and the actuators, similarly to the legs 26 and 28 in FIG. 2.

While specific embodiments of the invention have been described above, a person skilled in the art will understand that various modifications can be made without departing from the scope of the appended claims. For example, the frame member 14 shown in FIG. 2 may have more than one bar 30 extending parallel with the transverse legs 28. Conversely, while FIG. 6 shows three rows of pillars 40, there may be provided only a single row of such pillars extending in a transverse direction of the ink channels 18.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A print head for an ink-jet printer having a nozzle member, the print head comprising:

the nozzle member defining a plurality of ink channels arranged side-by-side, the ink channels forming a single row in transverse direction, each of the ink channels terminating in a nozzle to thereby provide a plurality of nozzles and each of the ink channels extending in a longitudinal direction across the nozzle member;

a plurality of actuators corresponding to said plurality of ink channels;

the plurality of actuators being disposed on one side of the nozzle member and facing the ink channels for pressurizing ink liquid therein, in order to expel ink droplets through the nozzles;

support means for supporting the actuators on the one side of the nozzle member, the plurality of actuators being located between the support means and the nozzle member; and a plurality of connecting portions mechanically connecting the support means to the nozzle member, at least one of said connecting portions being arranged between the actuators, the connecting portions being spaced apart from one another in the longitudinal direction of the ink channels.

2. The print head according to claim 1, wherein said connecting portions comprise at least one continuous bar extending perpendicularly to the longitudinal direction of the ink channels, and wherein at least two actuators are disposed on opposite sides of said bar and are provided for each ink channel.

3. The print head according to claim 2, wherein said plurality of connecting portions including the at least one continuous bar are interconnected by longitudinal legs to form a frame and wherein the at least one continuous bar is integrally formed with the longitudinal legs.

4. The print head according to claim 2, wherein at least two of the plurality of actuators are associated with each individual ink channel and wherein the print head further comprises means for energizing the at least two actuators associated with a same ink channel, the means energizing the at least two actuators at different timings such that an acoustic pressure wave that has been produced by one of the actuators and propagates in the ink channel is amplified by the other actuator.

5. The print head according to claim 4, wherein said plurality of connecting portions including the at least one continuous bar are interconnected by longitudinal legs to form a frame and wherein the at least one continuous bar is integrally formed with the longitudinal legs.

6. The print head according to claim 2, further comprising a flexible plate connected to both the nozzle member and the connecting portions, the ink channels being defined by recesses formed in the nozzle member and being covered by the flexible plate, and a surface of the bar facing the flexible plate having a plurality of grooves with raised portions therebetween, the grooves being aligned with the ink channels and the bar being connected to the flexible plate only in the raised portions between the grooves.

7. The print head according to claim 6, wherein the flexible plate is fixedly connected to both the nozzle member and the connecting portions.

8. The print head according to claim 6, wherein said plurality of connecting portions including the at least one continuous bar are interconnected by longitudinal legs to form a frame and wherein the at least one continuous bar is integrally formed with the longitudinal legs.

9. The print head according to claim 6, wherein at least two of the plurality of actuators are associated with each individual ink channel and wherein the print head further comprises means for energizing the at least two actuators associated with a same ink channel, the means energizing the at least two actuators at different timings such that an acoustic pressure wave that has been produced by one of the actuators and propagates in the ink channel is amplified by the other actuator.

10. The print head according to claim 9, wherein said plurality of connecting portions including the at least one continuous bar are interconnected by longitudinal legs to form a frame and wherein the at least one continuous bar is integrally formed with the longitudinal legs.

11. The print head according to claim 1, wherein each of the plurality of actuators is shaped as elongated plates disposed parallel with one another and with the ink channels with clearances being formed between the individual actuators, and the at least one connecting portion arranged between the actuators being a plurality of individual pillars.

12. The print head according to claim 11, wherein the elongated plates of the actuators are formed with grooves in surfaces thereof which face the pillars.

13. The print head according to claim 11, wherein said plurality of pillars are arranged in at least one row extending generally perpendicularly to the longitudinal direction of the ink channels.

14. The print head according to claim 13, wherein the elongated plates of the actuators are formed with grooves in surfaces thereof which face the pillars.

15. The print head according claim 1, further comprising at least one longitudinal leg which is connected to each of the plurality of connecting portions to form a frame member surrounding the actuators, at least two of the connecting portions being formed by legs of the frame member which extend generally perpendicularly to the longitudinal direction of the ink channels.

16. The print head according to claim 15, wherein at least one of the connecting portions which extends generally perpendicularly to the longitudinal direction of the ink channels is a continuous bar which is formed integrally with the frame member.

* * * * *